US010517374B1

(12) United States Patent
Niemi

(10) Patent No.: US 10,517,374 B1
(45) Date of Patent: Dec. 31, 2019

(54) MASCARA MATE

(71) Applicant: RosaLee Ann Niemi, Eveleth, MN (US)

(72) Inventor: RosaLee Ann Niemi, Eveleth, MN (US)

( * ) Notice: Subject to any disclaimer, the term of this patent is extended or adjusted under 35 U.S.C. 154(b) by 0 days.

(21) Appl. No.: 15/732,676

(22) Filed: Dec. 13, 2017

Related U.S. Application Data

(60) Provisional application No. 62/603,820, filed on Jun. 12, 2017.

(51) Int. Cl.
*A45D 40/24* (2006.01)
*A45D 40/26* (2006.01)
*A45D 40/18* (2006.01)

(52) U.S. Cl.
CPC ..... *A45D 40/265* (2013.01); *A45D 40/18* (2013.01)

(58) Field of Classification Search
CPC ..... A45D 40/24; A45D 40/26; A45D 40/262; A45D 40/265; A45D 40/18
See application file for complete search history.

(56) References Cited

U.S. PATENT DOCUMENTS 2,964,045 A * 12/1960 Otto ..... A45D 40/265 132/317
5,052,839 A * 10/1991 Pettengill ..... A45D 40/265 401/10
6,120,202 A * 9/2000 Donsky ..... A45D 34/045 401/17
2002/0094224 A1* 7/2002 Kaufman ..... A45D 34/045 401/17
2008/0006287 A1* 1/2008 Gueret ..... A45D 40/265 132/218

* cited by examiner

*Primary Examiner* — Rachel R Steitz
(74) *Attorney, Agent, or Firm* — Michael A. Essien; Essien Law Office, PLLC

(57) ABSTRACT

The only one chamber container of mascara substance keeps adding the mascara substance to the mascara applicator each time it is used unless the mascara applicator is cleaned after each use. The multiple layers of the mascara substance on the applicator creates a heavy laden mascara substance when applied to the eye lashes, eye brows or mustache. The mascara mate offers an alternative simple solution for applying a clean one coat application of the mascara substance each time it is applied to the eye lashes, eye brows or mustache. The mascara mate offers a clean storage chamber when the mascara applicator is not in use and a snap on cap for the chamber storing the mascara substance eliminating the drying out of the mascara substance.

4 Claims, 2 Drawing Sheets

MASCARA MATE

FIELD OF INVENTION

This invention is directed to the cosmetic industry and specifically to the mascara mate which provides for the smooth application of the mascara substance and an additional chamber for the cleansed applicator.

BACKGROUND

Prior art mascara applicators consisting of only one chamber holds both the mascara substance and the mascara applicator. Returning the mascara applicator to the chamber holding the mascara substance after each use, creates that heavy laden mascara substance on the applicator. Unless the applicator is cleansed after each use, the mascara substance will continue to build up. That is definitely a need for a mascara container with more than one chamber. One container to hold the mascara substance and another to hold a cleansed mascara applicator.

OBJECTS OF THE INVENTION

The main object of the invention is to provide a simple and effective alternative method for the application of the mascara substance. This method will eliminate any mascara substance to build up on the mascara applicator.

The other object is to provide for a container to hold the cleansed applicator when not in use. In addition it provides for a cap for the chamber holding the mascara substance eliminating any drying out of the mascara substance.

SUMMARY

The mascara mate eliminates the applicator containing the mascara substance from being returned to the one only chamber which when inserted into the one only chamber adds more of the mascara substance to the applicator. Wherein in utilizing the added mascara substance on the applicator from the one only chamber the applicator creates a heavy laden mascara substance for applying to the eye lashes, eye brows, or mustache. The mascara mate offers a simple alternative method for applying the mascara substance which provides for a clean or one coat application of the mascara substance to the applicator each time it is needed. This creates a soft application of the mascara substance to the eye lashes, eye brows, or mustache. It addition it provides for a clean storage chamber when not in use and cap for the chamber storing the mascara substance. This cap will eliminate the drying out of the mascara substance.

REFERENCE NUMERALS

Figure 2:
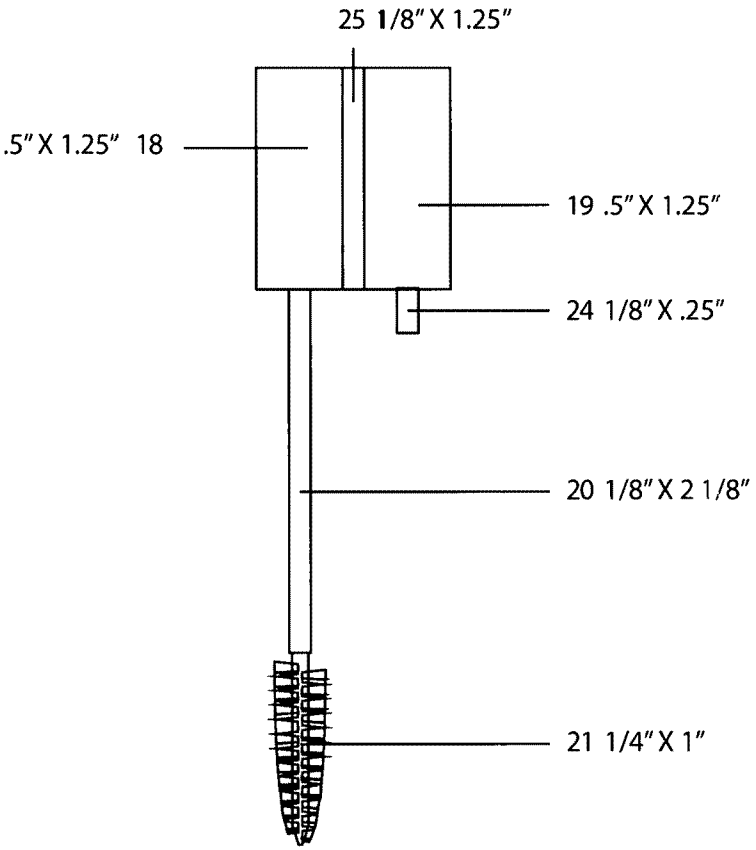
FIG. 2 is a front perspective view of an embodiment having two caps. One cap has an extension wand and applicator. The other cap has a shorter extension wand in accordance with the embodiment.

11. narrow strip tightly joining the two chambers 14, 16
12. the lips on the two chambers 14,16 for the snap on caps 18,19
14. the chamber containing the mascara substance
16. the hollow chamber
18. the snap on cap holding the extension wand 20 and applicator 21
19. the snap on cap holding the shorter wand
20. the wand extension from snap on cap 18
21. the applicator from the wand extension 20
24. the short extension from snap on cap 19
25. the narrow strip tightly joining the two snap on caps 18, 19

DETAILED DESCRIPTION OF THE EMBODIMENT

Figure 1:
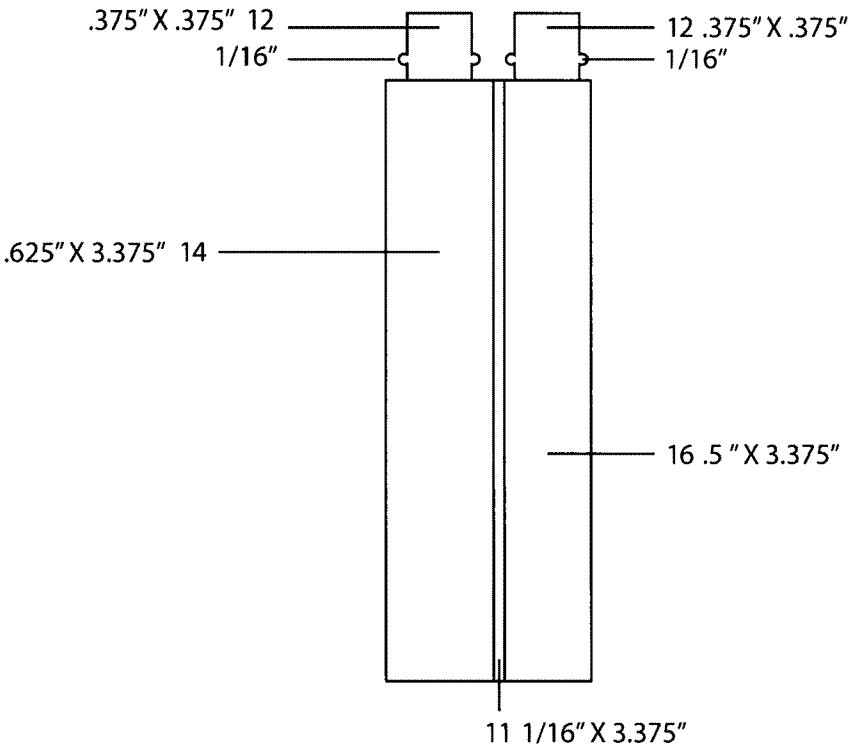
FIG. 1 is a perspective view of a two chamber container in accordance with the embodiment.

FIG. 1 is the perspective front view of the container with two independent chambers in accordance with the embodiment. The chamber 14 containing the mascara substance is open at the top and closed at the bottom. Chamber 16 is hollow with an opening at the top and either closed or open at the bottom. A narrow strip 11 tightly joins the two chambers 14,16.

FIG. 2 is a perspective front view of the two snap on caps 18, 19 and the extensions 20, 21, 24 in accordance with the embodiment. Snap on cap 18 has a wand extension 20 with an attached mascara substance applicator. The snap on cap 19 has a shorter extension 24. A narrow strip 25 tightly joins the two snap on caps 18, 19.

DETAILED DESCRIPTION OF THE OPERATION OF THE EMBODIMENT

Figure 3:
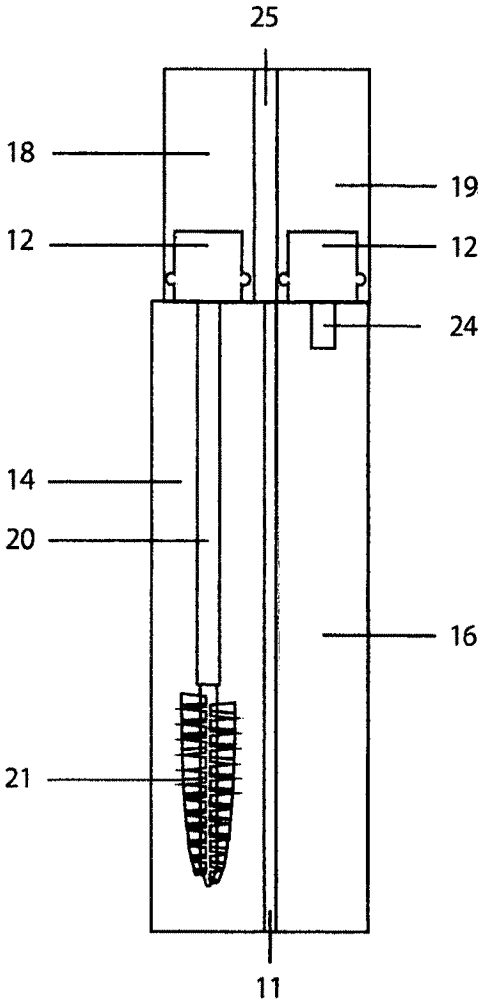
FIG. 3 is a front perspective view of the embodiment with a capped extension wand with applicator in the chamber containing the mascara substance. The other cap with the shorter extension is in the hollow chamber in accordance with the embodiment.

FIG. 3 is a perspective front view of the mascara mate when the user is ready to apply the mascara substance. The snap on cap 18 with the want extension 20 and the applicator 21 is inserted into the chamber 14 holding the mascara substance. The mascara substance is withdrawn on the applicator 21 ready for applying the mascara substance to the eye brows, eye lashes or mustache. The snap on cap 19 with the short wand extension inserts into chamber 16.

Figure 4:
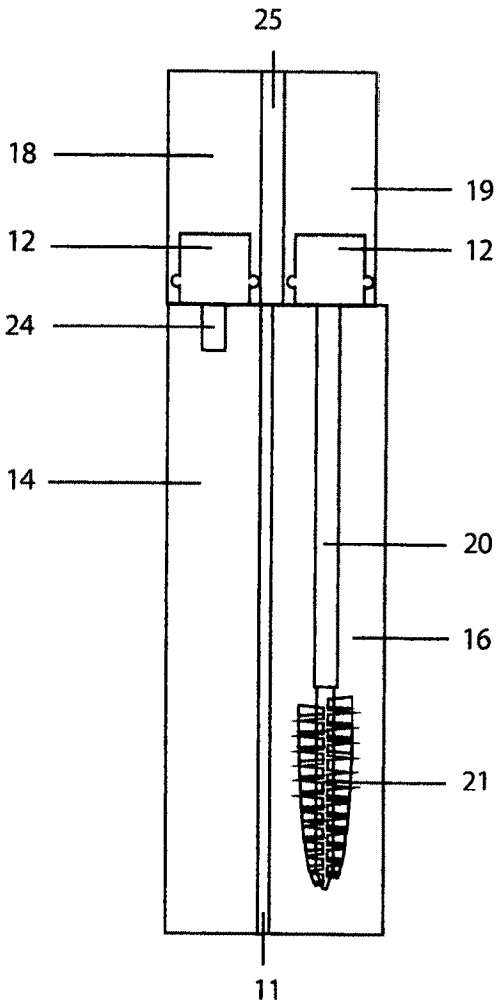
FIG. 4 is a front perspective view of the embodiment with the cap having the shorter extension in the chamber containing the mascara substance and the cap with the extended wand and applicator in the hollow chamber.

FIG. 4 is a perspective front view of the mascara mate when the user has completed the application of the mascara substance. The user can either clean or not clean the mascara substance from the applicator 21. The snap on cap 18 with the wand 20 and applicator 21 is inserted into the hollow chamber 16. The hollow chamber 16 has a closed or open bottom. The snap on cap 19 with the short wand extension 24 is inserted into the chamber 14 holding the mascara substance. The snap on cap 19 then seals chamber 14 holding the mascara substance assuring the freshness of the mascara substance for the next use.

I claim:

1. A mascara mate comprising:

a first and a second open chambers, wherein the first open chamber is usable as a reservoir for mascara substance and the second open chamber is free of any substance;

an applicator handle having a single brush end and a stopper end wherein the stopper end is suitable to close the mascara substance chamber, and further wherein the single brush end is usable for the application of mascara substance;

wherein when in storage, the applicator brush is kept in the second chamber that is free of any substance without insertion in the chamber with mascara substance wherein the second open chamber is open on a bottom end of the chamber.

2. The mascara mate of claim 1, wherein the first open chamber is cylindrical in shape and suitable to hold mascara substance.

3. The mascara mate of claim 1, wherein the first open chamber includes a top portion suitable to operably close the chamber.

4. The mascara mate of claim 1, wherein the second open chamber provides a clean cylinder for a mascara brush applicator.

* * * * *